US009284028B1

(12) United States Patent
Hoban

(10) Patent No.: US 9,284,028 B1
(45) Date of Patent: Mar. 15, 2016

(54) ALERT WRISTBAND DEVICE

(71) Applicant: Pullit Inc., Tustin, CA (US)

(72) Inventor: Vicki L Hoban, Tustin, CA (US)

( * ) Notice: Subject to any disclaimer, the term of this patent is extended or adjusted under 35 U.S.C. 154(b) by 375 days.

(21) Appl. No.: 13/874,354

(22) Filed: Apr. 30, 2013

Related U.S. Application Data

(60) Provisional application No. 61/641,127, filed on May 1, 2012.

(51) Int. Cl.
*B63C 9/05* (2006.01)
*B63C 9/00* (2006.01)

(52) U.S. Cl.
CPC ..... *B63C 9/0005* (2013.01)

(58) Field of Classification Search
CPC ..... B63C 9/20; G09F 21/02
See application file for complete search history.

(56) References Cited

U.S. PATENT DOCUMENTS

| | | | | |
|---|---|---|---|---|
| 827,350 | A | 7/1906 | Crofford | |
| 1,140,358 | A * | 5/1915 | Cleave | 441/81 |
| D56,828 | S | 12/1920 | Meyer | |
| 4,462,116 | A * | 7/1984 | Sanzone et al. | 2/170 |
| 4,523,913 | A * | 6/1985 | Kaino | 441/81 |
| D280,255 | S | 8/1985 | Blaivas | |
| 5,839,932 | A * | 11/1998 | Pierce et al. | 441/80 |
| 6,129,036 | A | 10/2000 | King et al. | |
| 6,481,366 | B1 | 11/2002 | Patera | |
| 6,527,605 | B1 | 3/2003 | Charte | |
| 6,786,784 | B2 | 9/2004 | Charte | |
| 7,479,891 | B2 | 1/2009 | Boujon | |
| 7,554,453 | B2 | 6/2009 | Snyder et al. | |
| 2002/0084295 | A1 * | 7/2002 | Martindale et al. | 224/219 |
| 2007/0169682 | A1 * | 7/2007 | Boyd | 116/173 |

* cited by examiner

*Primary Examiner* — Edwin Swinehart
(74) *Attorney, Agent, or Firm* — Thomas W. Galvani, P.C.; Thomas W. Galvani

(57) ABSTRACT

An alert wristband device for use by a swimmer includes a wristband, an alert coupled to the wristband for movement between a stored condition and a deployed condition, and a pull coupled to the alert. The pull has a rigid, enlarged head which defines a prominent grasping point on the wristband for the swimmer to pull when the swimmer is in distress. The alert is a flag, and in the stored condition of the alert, the flag is within an interior storage volume inside the wristband. The flag moves into the deployed condition in response to the swimmer pulling on the pull, so that the flag is pulled out of the wristband and may be waved to signal distress.

17 Claims, 6 Drawing Sheets

ALERT WRISTBAND DEVICE

CROSS-REFERENCE TO RELATED APPLICATIONS

This application claims the benefit of U.S. Provisional Application No. 61/641,127, filed May 1, 2012.

FIELD OF THE INVENTION

The present invention relates generally to swimming aids, and more particularly to alerts for use by distressed swimmers.

BACKGROUND OF THE INVENTION

A danger of drowning exists in all bodies of water. The danger increases when the body of water is murky or large, if the swimmer is young or under the influence or alcohol, or if a lifeguard is not present. The watchful eye of a parent or friend can reduce the danger, but most parents are not lifeguards trained to recognize a distressed or drowning swimmer. Often times, a child can slip below the surface of dark water without notice, becoming virtually impossible to see, or, in a crowded pool, a child's thrashing arms can be confused with youthful exuberance and play.

A swimmer generally moves through several stages of drowning before succumbing to death. Most drownings are wet drownings, in which the victim breathes in water. Much rarer are dry drownings, in which the victim's throat uncontrollably spasms, causing it to shut and suffocate the victim. In a wet drowning, a swimmer typically initially becomes tired and will alternate to an easier stroke to move forward, will float on his back, or will reach for a buoy or lane line to rest. A swimmer may perceive the danger he is in and signal for help. He can respond to a rescuer's questions without panic and is not in immediate risk of death.

Once the swimmer becomes anxious or begins to panic, however, he becomes a distressed swimmer. A distressed swimmer no longer makes forward progress and is unable to keep his head above water. He may be able call out and wave his arms for help, but only has a few minutes before he becomes a drowning victim. Time is of the essence, but a distressed swimmer still has some time to appreciate the danger he is in and alert onlookers before he begins to drown.

When a swimmer becomes a drowning victim, he generally enters the active drowning stage first. The swimmer can no longer effectively call out or wave for help, but instead flails his arms to the side in an attempt to press down on the water and keep his head above the surface. His head is seldom above water, however, and when it is, his focus is on catching a breath of air and not on crying out for help. An actively drowning swimmer is typically vertical in the water.

An actively drowning victim who is not rescued will slip into unconsciousness and become a passive drowning victim. A passive drowning victim stops flailing, stops breathing, stops moving, and floats face down just below the surface, or, more likely, begins to sink downward. Immediate rescue of such a victim is necessary to quickly restore circulation of oxygen and possibly blood throughout the swimmer's body.

Lifeguards are trained to recognize the various stages of drowning and are employed to intervene when a swimmer becomes distressed. However, a lifeguard is not always present, and parents and friends may not recognize the severity of the situation. Moreover, a swimmer in the ocean may be too far out to be heard, or the sound of the surf may cover his cries for help. Onlookers may assume the swimmer is joking or playing around, or they may not want to risk embarrassment should they try to rescue a swimmer not in distress. However, because active drowning victims are struggling to breathe, moments away from unconsciousness, and cannot alert onlookers of their danger, those assumptions and fears of embarrassment can have dire consequences. Moreover, because distressed or actively drowning swimmers focus primarily on keeping their head above water, they may not be able to call out to onlookers to inform them that the danger is real.

SUMMARY OF THE INVENTION

According to the principle of the invention, an alert wristband device for use by a swimmer includes a wristband, an alert coupled to the wristband for movement between a stored condition and a deployed condition, and a pull coupled to the alert. The pull has a rigid, enlarged head which defines an accessible, prominent grasping point on the wristband for the swimmer to grasp and pull when the swimmer is in distress. The alert is a flag, and in the stored condition of the alert, the flag is within an interior storage volume inside the wristband. The alert moves into the deployed condition when the swimmer pulls on the pull, so that the flag is pulled through an opening in the wristband, becomes unfurled, and may be waved to signal distress. In some embodiments of the alert wristband device, the wristband is buoyant and the flag is constructed of a hydrophobic material. In some embodiments of the alert wristband device, the pull is coupled to the flag with a lead which is inelastic, and the flag is coupled to the wristband with a tether which is elastic.

BRIEF DESCRIPTION OF THE DRAWINGS

Referring to the drawings.

DETAILED DESCRIPTION

Figure 1:
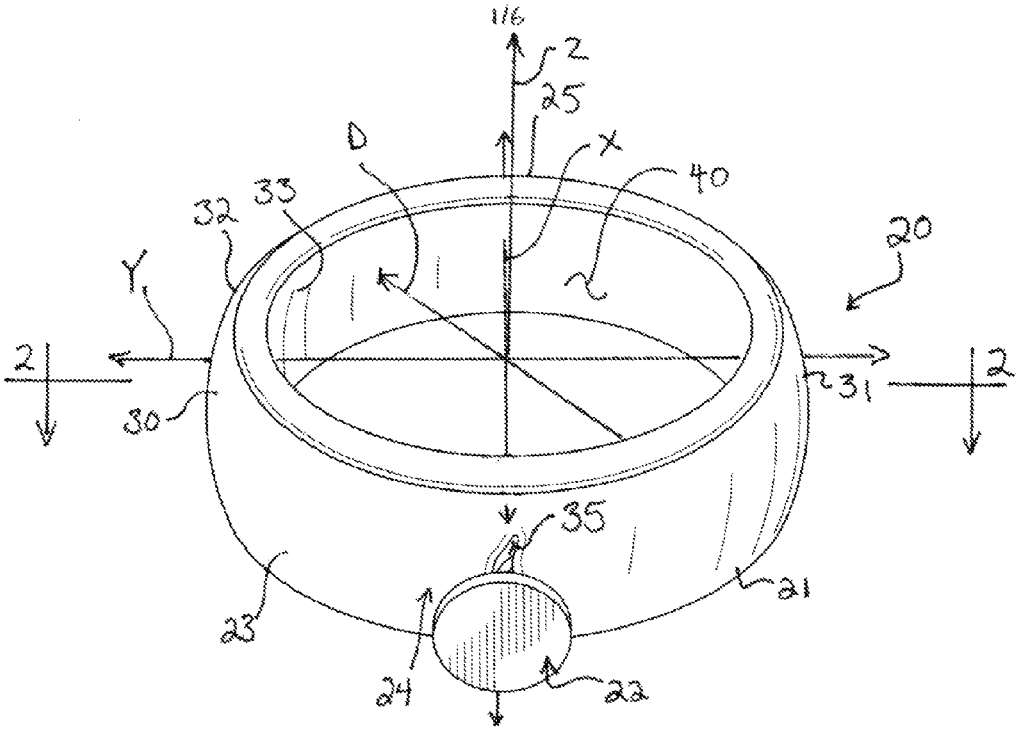
FIG. 1 is a front perspective view of an alert wristband device constructed and arranged in accordance with the principle of the invention, including a wristband and an alert with a pull.

Reference now is made to the drawings, in which the same reference characters are used throughout the different figures to designate the same elements. FIG. 1 illustrates an alert wristband device 20 constructed and arranged in accordance with the principle of the invention including a wristband 21 and an alert 22 coupled to the wristband 21 for movement between a stored condition, for use when the alert wristband device 20 is worn on the arm of a swimmer, and a deployed condition, for use when the swimmer is in distress and needs to signal for attention. FIG. 1 displays the alert 22 in the stored condition. As the term is used here, "swimmer" is meant to include any operator of the alert wristband device 20, whether the operator is a swimmer, surfer, kayaker, triathlete, canoeist, scuba diver, sailor, whale watcher, water tourist, or like person who wears the alert wristband device 20. The term swimmer will be used for simplicity.

The wristband 21 is a continuous, toroidal sleeve 23 and includes a front 24, a back 25, and opposed sides 30 and 31. A toroidal sleeve is a sleeve having the shape of a toroid, which is a generally regular ring, and is defined by a circle rotated about an axis offset from the circle by a radius. The front and back 24 and 25 are opposed with respect to each other along an axis X indicated in FIGS. 1 and 2. Likewise, the sides 30 and 31 are opposed with respect to each other along an axis Y, indicated in FIGS. 1 and 2, which is transverse to axis X. The front 24, back 25, and sides 30 and 31 are identified here for reference purposes and to enable clear discussion of the alert wristband device 20. An axis Z is normal to both axes X and Y, as shown in FIG. 1, and is oriented into and out of the page in FIG. 2. The sleeve 23 is generally symmetric about axis Z.

The sleeve 23 is constructed from a material or combination of materials having the material characteristics of elasticity, durability, deformability, size- and shape-memory, and buoyancy, such as neoprene, rubber, or the like.

Figure 2:
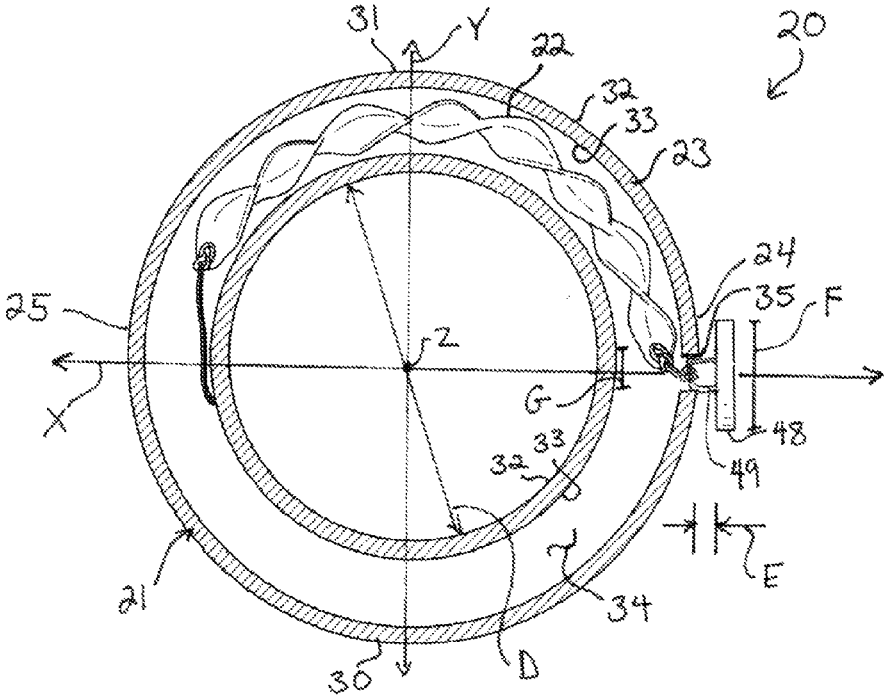
FIG. 2 is a section view taken along the line 2-2 in FIG. 1 showing a flag of the alert in a stored condition within the wristband of FIG. 1.

As seen in FIG. 2, the sleeve 23 is a sidewall with an outer surface 32 and an opposed inner surface 33 which bounds a toroidal interior storage volume 34 extending continuously around the wristband 21 within the sleeve 23. The interior storage volume 34 defines a retaining space in which a portion of the alert 22 is received and stored when the alert 22 is in the stored condition, as will be explained later. An opening 35 is formed in the front 24 of the sleeve 23 in communication with and providing access to the interior storage volume 34, providing a passage through which the alert 22 is applied into the interior storage volume 34 and removed from the interior storage volume 34.

Figure 3:
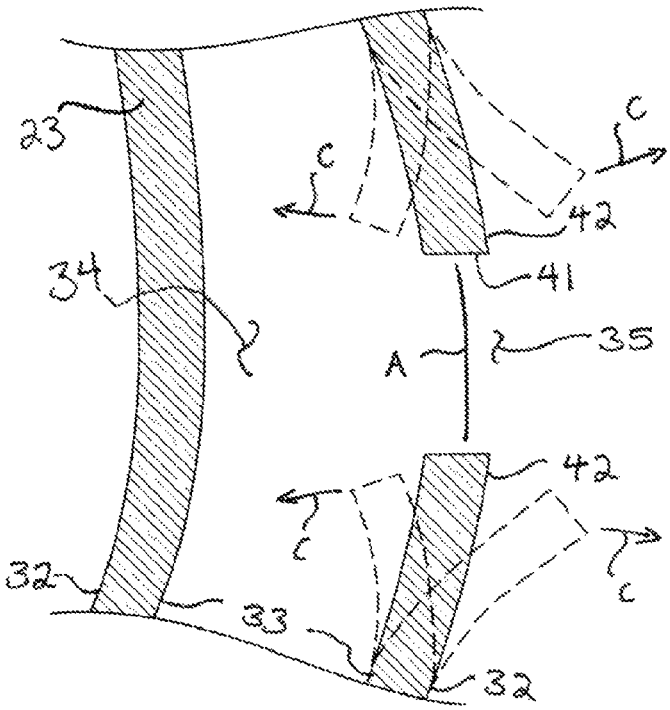
FIG. 3 is an enlarged section view taken along the line 2-2 in FIG. 1 showing an opening in the wristband of FIG. 1.

FIG. 3 is an enlarged section view of the opening 35 taken along line 2-2 in FIG. 1 and shown without the alert 22 for clarity. The opening 35 in the sleeve 23 is formed by an incision through the sleeve 23 from the outer surface 32 to the inner surface 33. As the opening 35 is formed by an incision, the opening 35 is a straight and narrow opening defining a slit through sleeve 23. The incision is aligned with the axis Z and perpendicular to the axes X and Y, and the incision forms a mouth 41 with flaps 42 that each extend into the opening 35. The flaps 42 are continuous extensions of the sleeve 23, and as such, project into the opening 35 toward each other in a relaxed condition. In the relaxed condition of the flaps 42, the flaps 42 are also aligned along a curve indicated generally in FIG. 3 with the reference character A, which has a radius generally coextensive to that of the sleeve 23. The flaps 42 each individually deflect laterally, in a direction normal to the plane A, as shown in FIG. 3 with the arrowed lines C. Like the sleeve 23 of which the flaps 42 are constituent parts, the flaps 42 have shape-memory material characteristics, and those material characteristics bias the flaps 42 into the relaxed condition in the plane A when the flaps 42 are moved away from the relaxed condition.

Figure 4A:
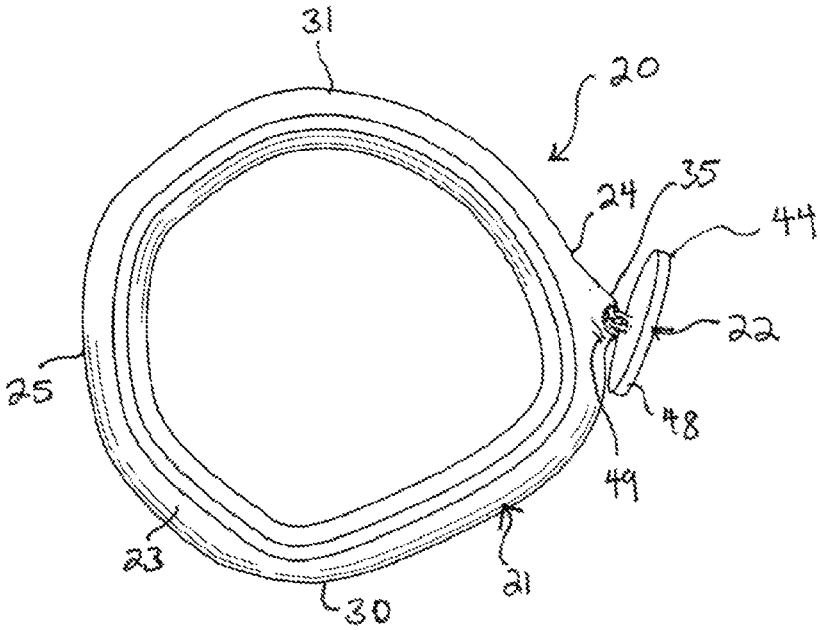
FIGS. 4A-4C illustrate a series of sequential steps of moving the alert of FIG. 1 from a stored condition to a deployed condition.

As seen in FIGS. 1, 2, and 4A, the outer surface 32 of the wristband 21 is free of structure other than the opening 35, the mouth 41, and the flaps 42 surrounding the opening 35. As such, the outer surface 32 presents a smooth, featureless surface with no protrusions. Some embodiments of the wristband 21 carry low-profile, decorative elements on the outer surface 32 which maintain the smooth characteristic of the outer surface 32.

Referring back to FIG. 1, the wristband 21 encircles a circular wrist-receiving space 40. The wrist-receiving space 40 has a diameter D, as shown in FIGS. 1 and 2, which is slightly smaller than a swimmer's wrist, and extends within the outer surface 33 of the wristband 21. The diameter D is generally between one and three inches, and the circumference of the wristband 21 is between three and nine inches. One having ordinary skill in the art will readily appreciate that different sizes of alert wristband devices 20 are available for different sizes of swimmers' wrists, and that the diameter D of the wrist-receiving space is preferably slightly smaller than the swimmer's wrist, so that the wristband 21 is held tightly on the wrist.

As mentioned above, the wristband 21 is preferably constructed from neoprene, the neoprene having a thickness of two millimeters to provide flotation to the wristband 21. The elastic material characteristics of the wristband 21 allow the wristband 21, and portions of the wristband 21, to stretch and be stretched along the X, Y, and Z axes and to expand and constrict radially. As the term is used here, "radial" means generally directed along a line extending inwardly and outwardly between a geometric center of the wrist-receiving space 40 bound by the wristband 21 and the sleeve 22. The size- and shape-memory material characteristics cause the wristband 21 to return to original size, shape, and configuration after being stretched. The durability characteristics of the wristband 21 prevent wear and loss of elasticity after repeated stretching.

Figure 4B:
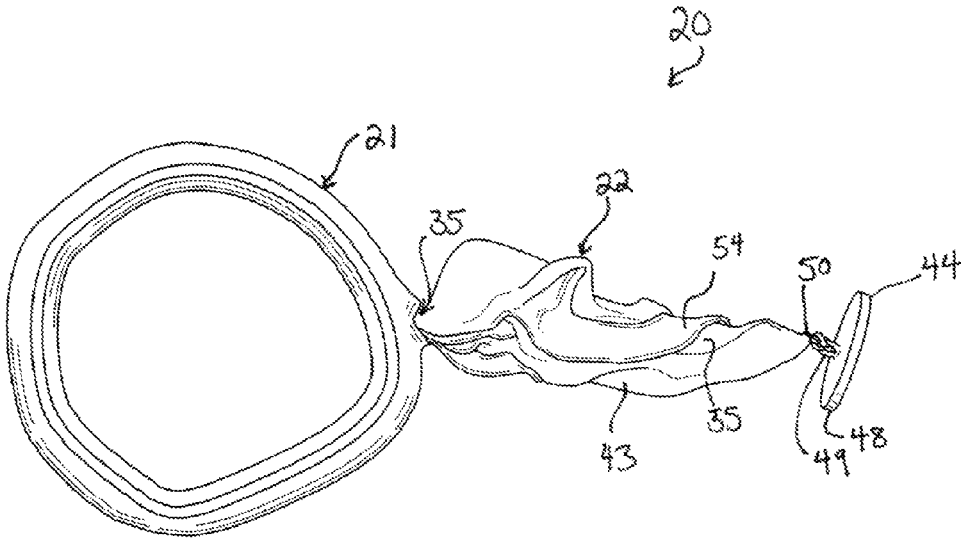
Figure 4C:
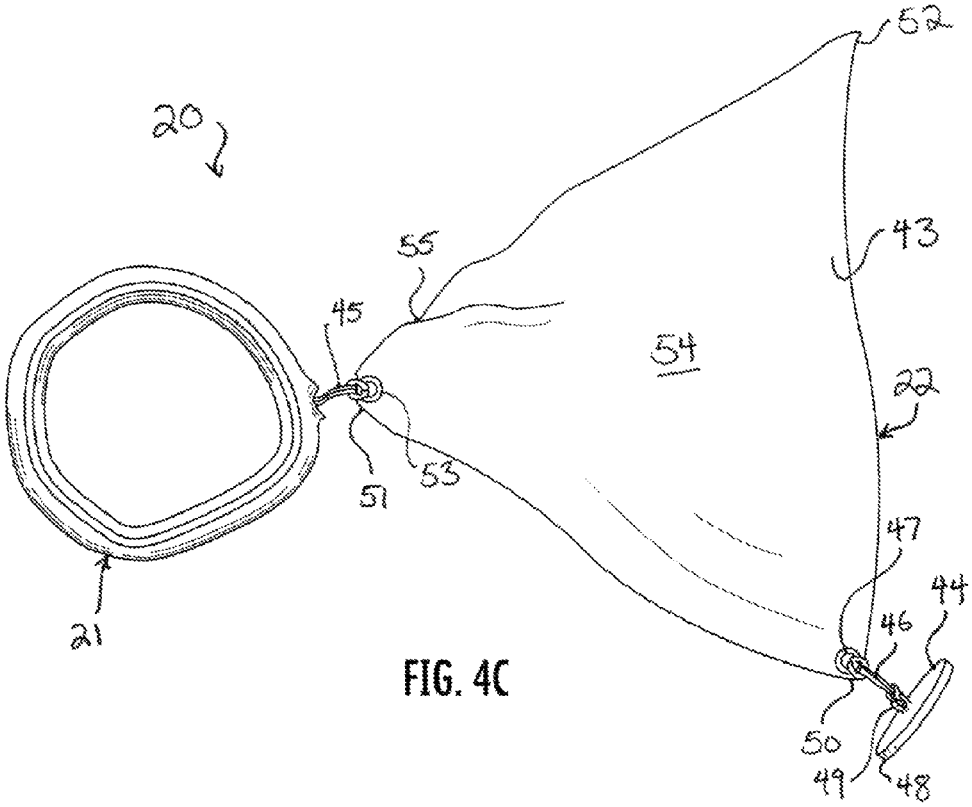

The alert 22 is coupled to the wristband 21 for movement between the stored condition and the deployed condition, as depicted sequentially in FIGS. 4A-4C. Turning first to FIG. 4C, which illustrates the alert 22 in the deployed condition, the various structural elements and features of the alert 22 are seen. The alert 22 includes a flag 43, a pull 44 secured to the flag, and a lead 45 coupling the flag 43 to the wristband 21. The flag 43 is a sheet of thin, flexible, strong, and durable fabric, such as ripstop nylon. The flag 43 is triangular and has opposed ends 50 and 51, and a corner 52 opposed from each of those ends 50 and 51. Though in the embodiment shown in FIG. 4C the flag 43 is triangular, one having ordinary skill in the art will appreciate that the flag 43 may have other shapes. The flag 43 has opposed faces 54 and 55 (as seen in FIGS. 4A and 4B), an extremely low thickness between the faces 54 and 55, and a broad surface area across the faces 54 and 55, providing the flag 43 with a high surface area to weight ratio of approximately one square yard per 1.15 ounces. The flag 43 is approximately 64 to 144 square inches, but may be larger or smaller. The material of the flag 43 is orange, yellow, neon, or some other bright or reflective color, and has a low porosity. The material of the flag 43 itself has a hydrophobic material characteristic to provide water resistance. Some embodiments of the flag 43 are further applied with a silicone-based coating to provide enhanced water resistance. The material of the flag 43 also has shape- and size-memory characteristics as well as very high shear and ultimate tensile strengths.

The pull 44 is secured to the end corner 50 of the flag 43. The pull 44 is a button, charm, collection of buttons or charms, disc, leather tie, or other small, rigid fixture. In an embodiment, the pull has an enlarged head 48 and a ring 49 mounted behind the head 48 defining a rearward extension of the head 48. The pull 44 is coupled at the ring 49 by a tether 46 to a grommet 47 secured in the end corner 50 of the flag 43, but the pull 44 may also be adhered, riveted, or securely fastened to the flag 43 in some other strong, permanent manner. In some embodiments, the flag 43 is directly secured to the head 48 of the pull 44 and the tether 46 is formed integrally within the head 48. The tether 46 is inelastic and resists stretching along its length without wear or damage. In other embodiments, the tether 46 is elastic, has size memory, and can be forcefully, dynamically, and cyclically stretched along its length without wear or loss of elasticity. The pull 44 is secured to the flag 43 opposite the end corner 51 where the lead 45 is coupled to the flag 43. The lead 45 is a cord extending from a grommet 53 in the end corner 51 of the flag 43, through the opening 35 in the wristband 21, into the interior storage volume 34, where the lead 45 is coupled to the inner surface 33 of the wristband 21 proximate to the back of the sleeve 35, as seen in FIG. 2. The lead 45 is elastic, has size memory, and can be forcefully, dynamically, and cyclically stretched along its length without wear or loss of elasticity. In other embodiments, the lead 45 is inelastic and has a high tensile strength, providing the lead 45 with great durability. The lead 45 is sewn to the inner surface 33 of the wristband 21 along the back 25 of the sleeve 23, opposite the opening 35, but may also be adhered, riveted, or securely fastened to the wristband 21 in some other strong, permanent manner.

The alert 22 moves between stored and deployed conditions. FIG. 4A illustrates the alert 22 in the stored condition, in which the lead 45 and the flag 43 are both entirely within the interior storage volume 34 within the wristband 21. In the stored condition, the flag 43 is stuffed into the interior storage volume 34 along one of the sides 30 and 31 and extends from the back 25 along the one of the sides 30 and 31 to the opening 35. The flag 43 is concealed entirely from view by and within the sleeve 23 between the back 25 and the opening 35. The pull 44 is at the opening 35, outside the wristband 21, presenting prominently above the outer surface 32 of the wristband 21, or any decorative element carried on the outer surface 32. In the stored condition of the alert 22, and as better seen in FIG. 2, the pull 44 is seated in the opening 35 with the ring 49 disposed in the opening 35 and the enlarged head 48 disposed outside of the opening 35 and directed away from the sleeve 23. The ring 49 is sized to fit snugly within the opening 35 and be closely encircled by the opening 35 in a snug-fit engagement with the opening 35 defined by a small amount of lateral or circumferential tolerance between the ring 49 and the opening 35, such as less than a quarter of the width G of the opening 35. The enlarged head 48 of the pull 44 is disposed outside of the opening 35 and defines a protrusion extending away from and above the outer surface 32 by a distance E, as seen in FIG. 2. The enlarged head 48 of the pull 44 has a diameter F that is larger than the width G of the opening 35, preventing passage of the pull 44 through the opening 35 into the interior storage volume 34 within the wristband 22. The ring 49 of the pull 44 seats the enlarged head 48 in the opening 35, and the enlarged head 48 of the pull 44 maintains the pull 44 above the outer surface 32 at the distance E and prevents the pull 44 from being stuffed into the interior storage volume 34, from which the pull 44 would be difficult to remove, especially in an emergency. In this way, the pull 44 seated in the opening 35 defines a protrusion past the otherwise smooth, featureless outer surface 32, which can be easily found, grabbed, and pulled by hand when the swimmer is in distress.

FIG. 4B illustrates the alert 22 in transition between the stored and deployed conditions. In FIG. 4B, the pull 44 has been pulled, as by hand, to just begin to remove and reveal the end corner 50 of the flag 43 from the wristband 21. As the flag 43 is removed from the wristband 21 through the opening 35, the flag 43 is still tightly bundled and kept together. The opening 35 deforms and expands to allow the bulk of the flag 43 to be pulled through the opening 35. So bundled, the bulk of the flag 43 is wider in diameter than the diameter G of the opening 35, so the opening 35 deforms to allow the flag 43 to be removed. In FIG. 4C, the flag 43 is fully withdrawn, and the shape-memory characteristics of the flag 43 have caused it to unfurl so that the ends 50 and 51 and the corner 52 are apart from each other, so that the flag 43 is ready for waving. The flag 43 is now fully visible outside of the sleeve 23.

Figure 5A:
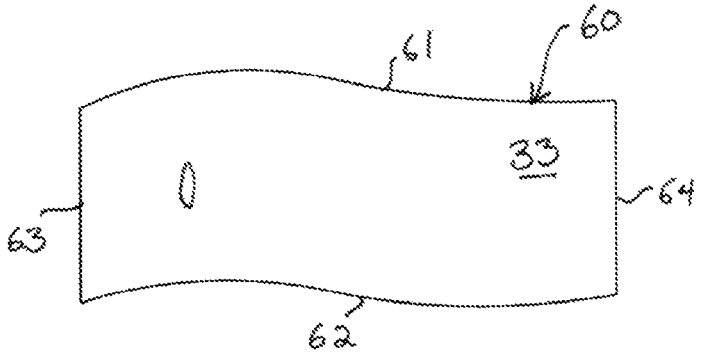
FIGS. 5A-5C illustrate a series of sequential steps of assembling the alert wristband device of FIG. 1.
Figure 5B:
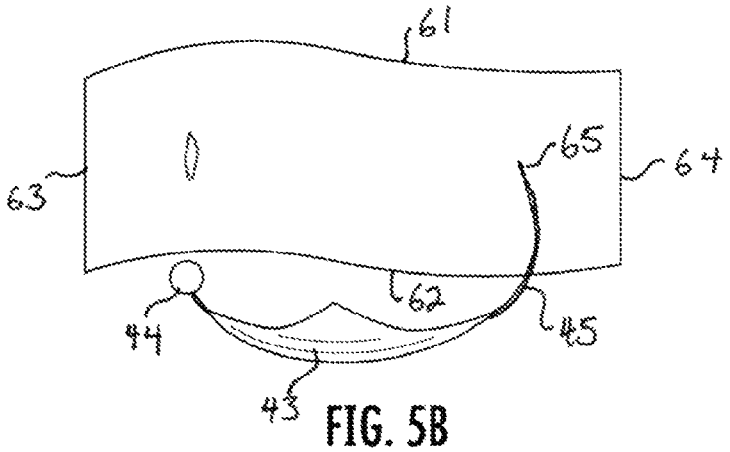
Figure 5C:
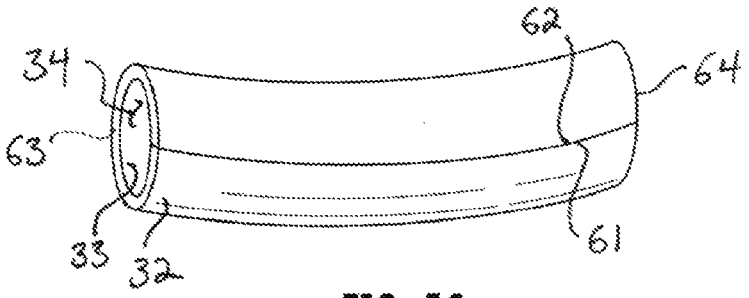

Referring now to FIGS. 5A-5C, the wristband 21 is formed from an elongate, triangular sheet 60 of material having opposed upper and lower edges 61 and 62, opposed side edges 63 and 64, and opposed outer and inner surfaces 32 and 33. The opening 35 is formed in the sheet 60 between the upper and lower edges 61 and 62 and between the opposed side edges 63 and 64, is aligned parallel to the side edges 63 and 64, and extends completely through the sheet 60 from the outer surface 32 to the inner surface 33. With reference now to FIG. 5B, to construct the wristband 21, the lead 45 is first secured to the inner surface 33 with stitching, fabric welding, or some other similar permanent fastening at an attachment point 65 located generally between the upper and lower edges 61 and 62 and inboard from the side edge 64. The pull 44 on the alert 22 is then passed through the opening 35 from the inner surface 33 to the outer surface 32 and the flag 43 is drawn through the opening 35 as well. The upper and lower edges 61 and 62 are then applied to and secured along each other with stitching, fabric welding, or the like, to form and arrange the sleeve 23 in an elongate, open-ended construction, as shown in FIG. 6C. The opposed side edges 63 and 64 are then brought together and sewn or fastened to each other, forming the toroidal wristband 21.

Although described here as a separate item to be worn on a swimmer's wrist, in some embodiments, the alert wristband device 20 is formed integrally to a sleeve in an article of clothing, such as in a wetsuit sleeve. In one such embodiment, the alert wristband device 20 is formed integrally at the end of a sleeve and constitutes an annular extension of the sleeve. In another such embodiment, the alert wristband device 20 is formed integrally along the sleeve and constitutes part of the sleeve. For example, many surfing, diving, and triathlon wetsuits are made from neoprene. In embodiments in which the alert wristband device 20 is formed in the wetsuit, the sleeve of the wetsuit would terminate at the alert wristband device 20 formed integrally with the sleeve.

Figure 6:
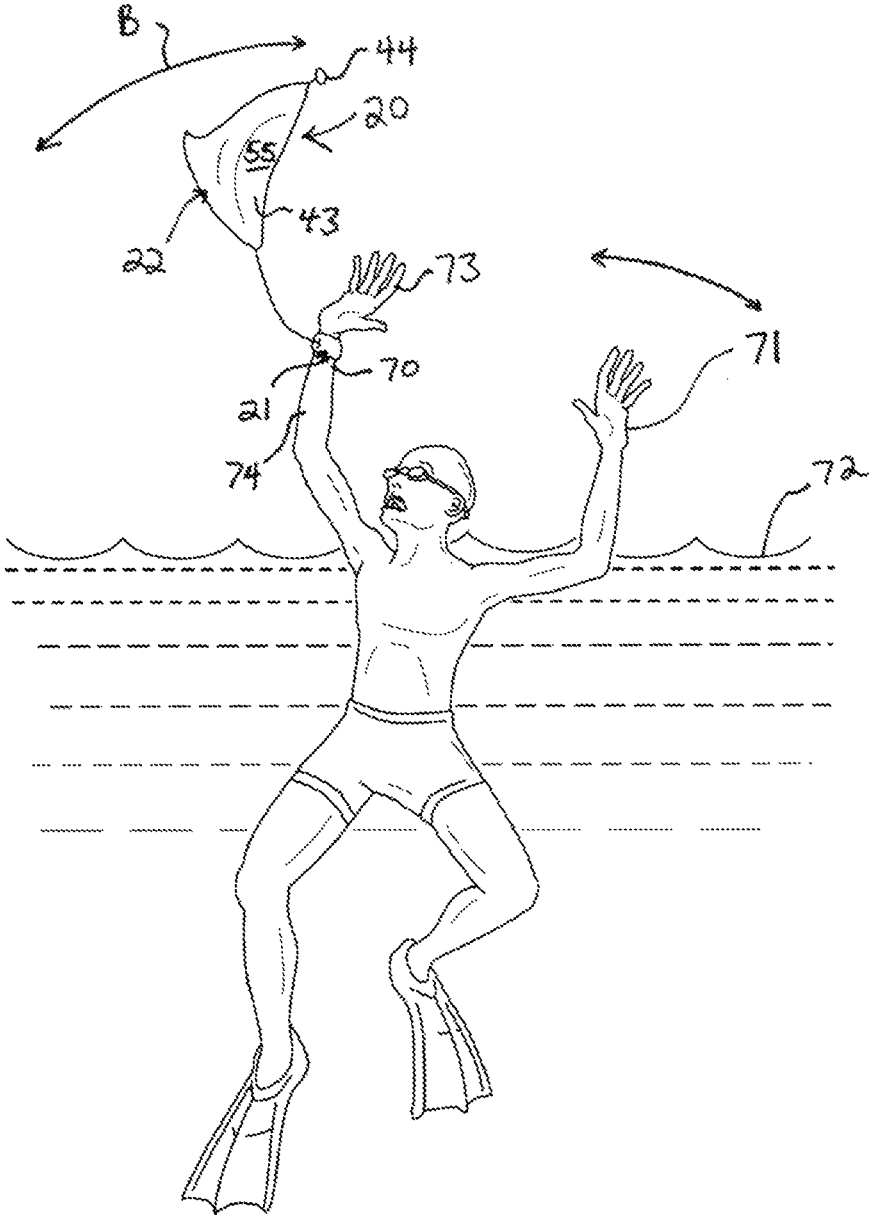
FIG. 6 illustrates the alert wristband device of FIG. 1 in use by a distressed swimmer.

In operation, the alert wristband device 20 is worn on the wrist 70 of a swimmer 71 when the swimmer 71 is proximate to or within a body of water 72, shown in FIG. 6. Before the swimmer 71 enters the water 72, the swimmer 71 applies the alert wristband device to his wrist 70. To apply the alert wristband device 20 to the swimmer 71, the alert wristband device 20 is taken up, as by hand, and passed over the hand 73 of the swimmer 71, the hand 73 being passed through the wrist-receiving space 40 until the alert wristband device 20 is located generally at the wrist 70 between the hand 72 and the forearm 74 of the swimmer 71. Because the wristband 21 is constructed of an elastic material having size- and shape-memory characteristics, the wristband 21 expands to accommodate the size of the hand 73 of the swimmer 71 and then constricts to closely encircle the wrist 70. The alert wristband device 20 is preferably worn so that the opening 35 and the pull 44 are on the underside of the forearm 74 and are directed inward toward the body of the swimmer 71 and toward the other hand of the swimmer 71.

With the alert wristband device 20 applied to the wrist 70, and the alert 22 in the stored condition, the swimmer 71 can now play around the water or swim in the water. If the swimmer becomes distressed, he moves the alert 22 of the alert wristband device 20 from the stored condition to the deployed condition. To move the alert 22 from the stored condition to the deployed condition, the swimmer 71 first grabs the pull 44 with his free hand. The swimmer 71 initially pulls on the pull 44 outwardly away from the sleeve 23, drawing the tether 46 out from the interior storage volume 34 through the opening 35. The enlarged head 48 of the pull 44 provides an accessible, prominent grasping point on the wristband 21, which has an otherwise smooth and featureless outer surface 32, so that the pull 44 is quickly and easily located, allowing the swimmer 71 to initiate movement of the alert 22 from the stored to the deployed conditions even when the swimmer 71 is panicked. In an emergency, the swimmer 71 will likely violently grab and pull the pull 44; the inelastic tether 46, secured to the grommet 47 in the flag 43, absorbs the force on the pull 44 and flag 43, preventing the pull 44 from separating from the flag 43. The inelasticity of the tether 46 causes direct and immediate removal of the flag 43 from the interior storage volume 34. Pulling of the pull 44 causes the flag 43 to withdraw from the interior storage volume 34 through the opening 35, as shown in FIG. 4B. The tether 46 resists stretching along its length and transfers the force of the pull by the swimmer 71 to the flag 43.

Pulling continues with the flag 43 continuing to exit from within the wristband 21. The flag 43 is under tension from between the grommet 47 at the end 50 and the portion of the flag 43 at the opening 35, causing the flag 43 to remain in a taut, quasi-furled condition, as shown in FIG. 4B, so that the force of the pulling is transmitted through the pull 44, through the tether 46, through the flag 43, and to the lead 45. Pulling continues until the alert 22 is moved into the deployed condition, shown in FIG. 4C, with the flag 43 outside of the wristband 21 and the lead 45 stretched, partially within the interior storage volume 34 and partially outside of the wristband 21. In this condition, the flag 43 is completely outside the wristband 21, the end corners 50 and 51 are opposed, and the surface of the flag 43 is loose from between the ends 50 and 51 and the corner 52, exposing both faces 54 and 55. Although the process of moving the alert 22 from a stored condition to a deployed condition is presented and described above as a series of sequential steps, it should be understood that the removal of the flag 43 is preferably accomplished in a single, fluid, continuous motion.

During pulling of the alert 22 from the stored condition to the deployed condition, the elastic characteristic of the lead 45 causes the force of the pull to be transferred and absorbed by the lead 45, so that the tether 46 and flag 43 are not damaged during the pull. Additionally, the inelastic characteristic of the tether 46 and the elastic characteristic of the lead 45 cause the flag 43 to withdraw immediately from the interior storage volume 34, as the force is transferred immediately from the pull 44 to the tether 46 to the flag 43, causing each of the components to move in response to the force of the pull, and then to the elastic lead 45, which absorbs the force of the pull.

With the alert 22 in the deployed condition, the swimmer 71 can signal a warning or need for help by waving his forearm 74 back and forth, as generally indicated by the double-arrowed line B in FIG. 6. Doing so will cause the flag 43 to fully unfurl, as shown, so that the faces 54 and 55 are large and visible. A swimmer 71 in the water who perceives danger, is distressed, or is actively drowning will often flail his arms about, causing the flag 43 to wave prominently in view. Additionally, because the flag 43 is constructed of a material having a low porosity and a hydrophobic material characteristic, water will bead off the flag 43, preventing the faces 54 and 55 of the flag 43 from sticking to themselves or each other and maintaining the flag 43 in a broad, open configuration.

Once the swimmer 71 has been rescued, or after the alert 22 has been deployed, the alert 22 is returned to the stored condition simply by pushing and stuffing the alert 22 back through the opening 35 and into the interior storage volume 34. A pencil or other elongate device suitable for stuffing the alert 22 is helpful for returning the alert 22 to the stored condition. In this way, the alert wristband device 20 is ready for repeated use.

Figure 7:
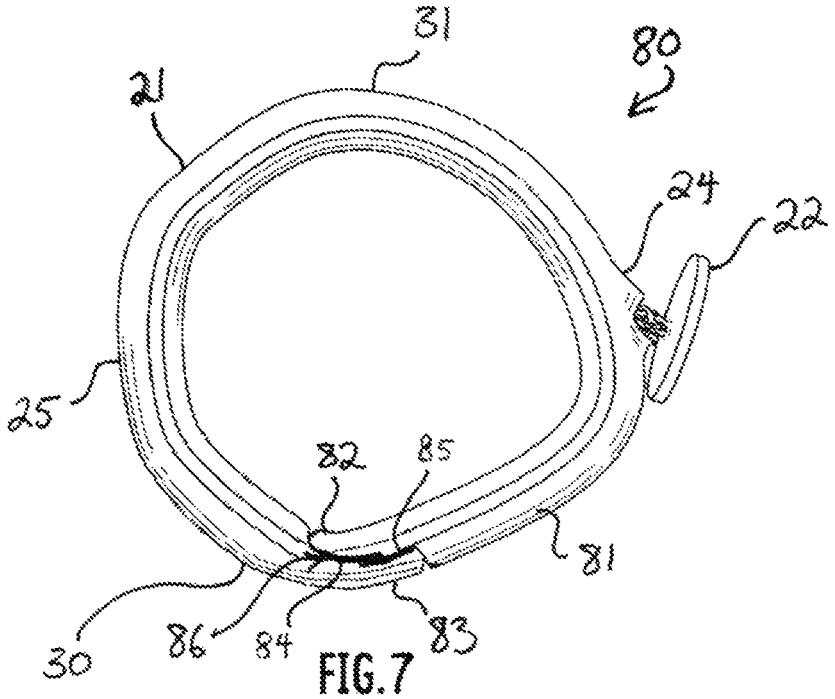
FIG. 7 is a top plan view of an alternate embodiment of an alert wristband device constructed and arranged in accordance with the principle of the invention.

An alternate embodiment constructed and arranged according to the principle of the invention is shown in FIG. 7, and is identified as an alert wristband device 80. The alert wristband device 80 is substantially the same as the alert wristband device 20, and as such carries the same reference characters as the alert wristband device 20, indicating the same structural features and elements. The alert wristband device 80 includes a wristband 21 and an alert 22 coupled to the wristband 21 for movement between a stored condition. The sleeve 81 of the alert wristband device 80 is toroidal like the sleeve 23 of the alert wristband device 20 but is severed, forming two flaps or closed ends 82 and 83. The ends 82 and 83 are formed on the side 30, opposite from side 31 in which the flag 43 of the alert 22 is stored in the stored condition thereof. One end 82 carries an engagement element 84 of an engagement pair 86, and the other end 83 carries a complementary engagement element 85 of the engagement pair 86, so that the two ends 82 and 83 are releasably engaged to each other. Preferably, the engagement element 84 is one of a hook and loop, and the complemental engagement element 85 is the other of the hook and loop. In this way, the end 82 can be placed at various points along the wristband 21 proximate to the end 83, so as to selectively locate the ends 82 and 83 with respect to each other and selectively set the circumference and diameter of the wristband 21 to accommodate a swimmer's wrist. In other embodiments, the engagement pair 86 is a pair of snap closures or other similar fastening assembly for releasably engaging the ends 82 and 83.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

The invention claimed is:

1. A device comprising:

a toroidal sleeve having an inner surface and an opposed outer surface;

an interior volume extends within the sleeve and is bounded by the inner surface;

an opening in the sleeve extends into the interior volume;

an alert is coupled to the sleeve for movement between a stored condition and a deployed condition; and a pull is coupled to the alert, the pull having a rigid, enlarged head which is larger than the opening in the sleeve;

wherein in the stored condition of the alert, the head is outside the opening.

2. The device of claim 1, wherein the pull is opposed from the sleeve on the alert.

3. The device of claim 1, wherein a tether couples the pull to the alert.

4. The device of claim 3, wherein the tether is inelastic.

5. The device of claim 3, wherein a lead couples the alert to the sleeve.

6. The device of claim 5, wherein the lead is elastic.

7. The device of claim 5, further comprising:

a front and an opposed back of the sleeve;

the opening is formed on the front of the sleeve through the sleeve into the interior volume;

the lead is coupled to the inner surface of the sleeve at the back of the sleeve opposed from the opening;

in the stored condition of the alert, the pull is within the sleeve; and in the deployed condition of the alert, the alert is outside the sleeve and the lead extends through the opening.

8. The device of claim 7, wherein in the stored condition of the alert, the outer surface is featureless but for the pull seated in the opening.

9. The device of claim 1, wherein the sleeve is buoyant.

10. The device of claim 1, wherein the alert is constructed of a hydrophobic material.

11. The device of claim 1, wherein:

the sleeve is severed forming two opposed ends; and the ends carry engagement elements of an engagement assembly for releasable engagement of the opposed ends with respect to each other.

12. A device comprising:

a toroidal sleeve bounding a toroidal interior volume extending continuously within the sleeve and formed with an opening;

an alert coupled within the interior volume for movement between a stored condition and a deployed condition;

a pull coupled to the alert to move the alert from the stored condition to the deployed condition, the pull including a rigid, enlarged head which is larger than the opening in the sleeve;

a ring is formed on the head of the pull and is coupled to the alert;

in the stored condition of the alert, the alert is within the sleeve, the pull is seated in the opening and directed away from the sleeve, the ring of the pull is in a snug-fit engagement in the opening, and the head of the pull is disposed outside of the opening; and in the deployed condition of the alert, the alert is outside the sleeve.

13. The device of claim 12, wherein:

an inelastic tether couples the pull to the alert;

an elastic lead couples the alert to the sleeve.

14. The device of claim 12, wherein:

the sleeve is buoyant; and the alert is constructed of a hydrophobic material.

15. A device comprising:

a toroidal sleeve bounding a toroidal interior volume extending continuously within the sleeve, the sleeve formed with an opening extending into the interior volume;

an alert coupled within the interior volume for movement between a stored condition and a deployed condition through the opening;

a pull is coupled to the alert to move the alert from the stored condition to the deployed condition, the pull having a rigid, enlarged head which is larger than the opening;

in the stored condition of the alert, the alert is concealed within the sleeve, and the pull is seated in the opening and is directed away from the sleeve; and in the deployed condition of the alert, the alert is outside the sleeve and is visible.

16. The device of claim 15, further comprising:

a front and an opposed back of the sleeve;

the opening is a slit formed on the front of the sleeve through the sleeve into the interior volume;

an elastic lead couples the alert to the inner surface of the sleeve at the back of the sleeve;

an inelastic tether couples the pull to the alert opposite from the elastic lead coupling the alert to the sleeve;

in the stored condition of the alert, the pull is in a snug-fit engagement in the opening; and in the deployed condition of the alert, the tether extends through the opening.

17. The device of claim 15, wherein:

the sleeve is buoyant; and the alert is constructed of a hydrophobic material.

* * * * *